US009475558B1

(12) United States Patent
Gilk et al.

(10) Patent No.: US 9,475,558 B1
(45) **Date of Patent: *Oct. 25, 2016**

(54) LONG SHAFT PROPELLER CONTROLLER AND BEARING SEAL PROTECTOR

(71) Applicants: Arlon J. Gilk, Albany, MN (US); Lawrence L. Hoeschen, Freeport, MN (US)

(72) Inventors: Arlon J. Gilk, Albany, MN (US); Lawrence L. Hoeschen, Freeport, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/572,738

(22) Filed: Dec. 16, 2014

Related U.S. Application Data

(63) Continuation of application No. 13/398,864, filed on Feb. 17, 2012, now Pat. No. 8,911,272.

(51) Int. Cl.

| | |
|---|---|
| ***B63H 1/18*** | (2006.01) |
| ***B63H 1/28*** | (2006.01) |
| ***B63H 5/125*** | (2006.01) |
| ***B63H 20/10*** | (2006.01) |
| ***B63H 1/14*** | (2006.01) |

(52) U.S. Cl.
CPC . *B63H 1/18* (2013.01); *B63H 1/14* (2013.01)

(58) Field of Classification Search
CPC .... B63H 1/14; B63H 1/18; B63H 2001/185; B63H 5/125
USPC ..... 440/53, 55, 66, 83; 114/271, 274, 285, 114/288
See application file for complete search history.

(56) References Cited

U.S. PATENT DOCUMENTS

| | | | | |
|---|---|---|---|---|
| 2,896,565 | A * | 7/1959 | Stevens | B63H 5/16 114/166 |
| 4,645,463 | A * | 2/1987 | Arneson | B63H 5/125 440/57 |
| 4,726,796 | A * | 2/1988 | Rivette, Jr. | B63H 5/1252 440/55 |
| 5,931,710 | A * | 8/1999 | Johnson, Sr. | B63H 5/125 440/55 |

* cited by examiner

*Primary Examiner* — Anthony Wiest
(74) *Attorney, Agent, or Firm* — Albert W. Watkins

(57) ABSTRACT

A marine propulsion system for shallow waters, swamps, savannahs and the like includes a rotating propeller shaft supporting a propeller. An anti-cavitation body defines a partial cylinder having a longitudinal axis adjacent to the propeller. The propeller generates a vacuum between the anti-cavitation body and a surface of a water body. First and second wings adjacent to edges of the anti-cavitation body are generally planar and operatively angled towards the bottom of a water body. The first and second wings are adjusted to run below the water body surface and seal the anti-cavitation body to maintain generated vacuum. A first thread is cut in a first helical direction at an end of the rotating propeller shaft adjacent the propeller, and slightly more distal therefrom a second thread is cut in a second helical direction opposed to the first thread helical direction. The second thread drives matter away from the bearing.

18 Claims, 5 Drawing Sheets

LONG SHAFT PROPELLER CONTROLLER AND BEARING SEAL PROTECTOR

CROSS REFERENCE TO RELATED APPLICATIONS

This application is a Continuation of U.S. patent application Ser. No. 13/398,864 filed Feb. 17, 2012 and granted as U.S. Pat. No. 8,911,272 on Dec. 16, 2014 co-pending herewith, of like title and inventorship, the contents which are incorporated herein by reference in entirety.

BACKGROUND OF THE INVENTION

1. Field of the Invention

The present invention pertains to marine propulsion systems generally, and more specifically to marine propulsion systems utilizing an elongated propeller drive shaft having a housing surrounding the propeller shaft.

2. Description of the Related Art

Modern marine vehicles are most commonly powered by an internal combustion engine mounted within the boat or above the water line adjacent the boat. The mechanical power generated by the engine is transferred through a drive shaft to a water propulsion device such as a propeller. These marine vehicles provide a mode of transportation for traversing bodies of water that may be relatively large and open, such as the larger lakes, rivers and oceans, or relatively smaller, such as streams or creeks, swamps, glades, savannahs and the like.

For boating in open waterways such as lakes, rivers or the oceans, the propeller shaft is typically relatively short, and may extend from the motor and away from the boat hull only a few inches or feet. The spacing between propeller and hull in this type of boat is substantially smaller than the overall length of the boat. This short propeller shaft also dictates that the propeller is placed fairly deep into the water, to allow water to circulate past the boat hull and reach the propeller, and to avoid interference between propeller and boat hull during turns and the like. In open waters, where few if any obstacles exist, this arrangement has proven to be very effective and is represented by standard inboard and outboard marine propulsion systems.

Unfortunately, when traversing smaller or shallower bodies of water, such as swamps, creeks and streams, the rounded boat hulls and deep propeller arrangements used in open waterways are no longer effective or useful. The hull runs deeper than some sections of these smaller waterways, or obstacles present therein, and the propeller readily becomes tangled in vegetative matter, or, worse, may be destroyed by the obstacles. Particularly for those applications where the water is either shallow or filled with many obstacles, the prior art inboard and outboard motors are unsatisfactory.

To traverse the shallower bodies of water or those littered with obstacles, a generally flat bottom boat hull is preferred. In addition, the propeller drive shaft is extended beyond the boat by a much greater distance. When extended, the propeller can be driven shallowly in the water, free of interference with the boat. When an obstacle is encountered, the boat may pass over and be clear of the obstacle while still being propelled by the motor. Boats that use this type of drive system are sometimes referred to as mud boats, owing to their substantially improved propulsion in shallow waters, swamps, and other muddy waters. A number of U.S. patents are illustrative of the prior art, including U.S. Pat. No. 941,827 by Trouche, entitled "Motor more especially applicable for driving barges, wherries, flatboats, and the like"; U.S. Pat. No. 1,953,599 by Grimes, entitled "Boat propulsion device"; U.S. Pat. No. 2,096,223 by Chandler et al, entitled "Boat propelling mechanism"; U.S. Pat. No. 3,752,111 by Meynier, entitled "Pivoting motor boat drive unit"; U.S. Pat. No. 4,676,756 by Rodrigue et al, entitled "Boat and propulsion system including a transom platform"; U.S. Pat. No. 4,678,440 by Rodrigue et al, entitled "Boat and propulsion system"; the contents of each which are incorporated herein by reference.

On propulsion systems having an extended drive shaft, it is commonplace to use a housing or casing to surround the drive shaft. Frequently, some type of shroud or structure is also provided to prevent the propeller from directly striking any obstacles, and instead deflects the casing, drive shaft and propeller away from the obstacle. Additional features may be associated with the propeller and casing, such as various reinforcing elements, stiffeners or frameworks. The casing isolates the rotating propeller shaft from people and objects, thereby preventing the shaft from entangling or harming people or objects. The casing also protects the shaft from impact with hazards, and provides additional structural support to the drive shaft.

Some long shaft motors illustrated in the prior art anchor the motor on or within the boat, and provide a flexible coupling such as a universal joint somewhere along the long shaft, permitting the motor to stay in a fixed position and only requiring the propeller and some portion of the shaft to be manipulated for steering and propulsion. One exemplary patent, the teachings and contents which are incorporated herein by reference, is U.S. Pat. No. 3,430,603 by Parish, entitled "Sheering apparatus for a swamp boat." Parish additionally illustrates another feature that is found in some mud motors, described therein as a cavitation plate. By placing the plate immediately above the prop, Parish observes that this plate reduces air-water turbulence at the prop, to increase the speed of the boat. U.S. Pat. No. 4,726,796 by Rivette J R et al, entitled "Driving and steering mechanism for boats," the teachings and contents which are also incorporated herein by reference, describes an "anti-ventilation plate" immediately above and adjacent to the prop.

A number of additional patents exemplary of the broader marine art and most generally illustrating various plates or guides adjacent to a prop, the teachings and contents which are also incorporated herein by reference, include U.S. Pat. No. 682,027 by Burgess, entitled "Propulsion of vessels"; U.S. Pat. No. 904,313 by Davis, entitled "Hood for propeller wheels"; U.S. Pat. No. 2,442,728 by Kiekhaefer, entitled "Drive shaft housing for outboard motors"; U.S. Pat. No. 2,528,628 by Whitney, entitled "Ventilated underwater internal-combustion engine"; U.S. Pat. No. 2,549,477 by Kiekhaefer, entitled "Gear case unit for outboard motors"; U.S. Pat. No. 2,549,484 by Kiekhaefer, entitled "Underwater gear unit for outboard motors"; U.S. Pat. No. 2,656,812 by Kiekhaefer, entitled "Gear case unit for outboard motors"; U.S. Pat. No. 2,860,594 by Kiekhaefer, entitled "Splash deflector"; U.S. Pat. No. 2,896,565 by Stevens, entitled "Hydraulic flow control plate"; U.S. Pat. No. 3,151,597 by Larsen, entitled "Impact absorbing means for marine propulsion"; U.S. Pat. No. 3,587,510 by Shimanckas, entitled "Marine propulsion device with split drive shaft"; U.S. Pat. No. 3,599,595 by James, entitled "Outdrive for boats"; U.S. Pat. No. 3,768,432 by Spaulding, entitled " "; U.S. Pat. No. 4,295,835 by Mapes et al, entitled "High speed outboard drive unit"; U.S. Pat. No. 4,549,949 by Guinn, entitled "Marine propulsion device including cathodic protection";

U.S. Pat. No. 4,597,742 by Finkl, entitled "Trimming arrangement for planing hulls"; U.S. Pat. No. 4,636,175 by Frazzell et al, entitled "Water inlet for outboard propulsion unit"; U.S. Pat. No. 4,708,672 by Bentz et al, entitled "Boat stabilizer"; U.S. Pat. No. 4,744,779 by Koehler, entitled "Outboard motor cavitation plate extension"; U.S. Pat. No. 4,781,632 by Litjens et al, entitled "Anti-ventilation plate"; U.S. Pat. No. 4,804,312 by Schneekluth, entitled "Flow guide for ship propellers"; U.S. Pat. No. 5,207,605 by Kroeber, entitled "Outboard propeller guard"; U.S. Pat. No. 5,667,415 by Arneson, entitled "Marine outdrive with surface piercing propeller and stabilizing shroud"; U.S. Pat. No. 5,673,643 by Poppa, entitled "Hydrofoil accessory for marine propulsion device"; U.S. Pat. No. 5,800,224 by Ogino, entitled "Splash and anti-cavitation plate for marine drive"; U.S. Pat. No. 5,820,425 by Ogino et al, entitled "Outboard drive lower unit"; U.S. Pat. No. 6,155,893 by Belmont, entitled "Lift-generating device for a power boat"; U.S. Pat. No. 6,361,388 by Foreman, entitled "Marine motor drive assembly"; U.S. Pat. No. 6,482,057 by Schoell, entitled "Trimmable marine drive apparatus"; U.S. Pat. No. 6,966,806 by Bruestle et al, entitled "Replaceable leading edge for a marine drive unit"; U.S. Pat. No. 7,335,074 by Arneson, entitled "Shroud enclosed inverted surface piercing propeller outdrive"; U.S. Pat. No. 7,387,553 by Misorski et al, entitled "Marine drive unit overmolded with a polymer material"; and U.S. Pat. No. 7,575,490 by Angel et al, entitled "Passive air induction system for boats". In addition to the foregoing patents, Webster's New Universal Unabridged Dictionary, Second Edition copyright 1983, is incorporated herein by reference in entirety for the definitions of words and terms used herein, unless explicitly otherwise defined herein.

An important issue for shallow water application is the location and inertia of the prop in the water. As aforementioned, there are many shallow obstacles. When an obstacle is encountered, the boat will typically strike the obstacle first. Desirably, the boat will be deflected, and, owing to the large area and significant framework typically found in a boat of this nature, the boat will be unharmed or sustain only cosmetic damage. The propeller will next encounter the hazard. The greater the mass at the end of a long shaft propeller, the more force that will be applied thereto to pivot the prop up and over the obstacle. Furthermore, the deeper the prop runs in the water, the more obstacles that will be encountered.

In the prior art, various plates nearby to the prop serve various purposes, depending upon design, but frequently are used as protection for the prop against direct impact with an obstacle such as a tree or rock. In addition, some artisans use a plate to "trim" the motor, setting the running angle of the prop in the water. As aforementioned, a few of these prior art plates were also described as anti-cavitation or anti-ventilation plates. Heretofore, with or without these various plates, the boat operator is required to manually control the depth of the prop, physically absorbing and damping the movements thereof while still trying to control the depth of the prop in the water most appropriately for each given instant. This proves to be both difficult and physically taxing.

Another limitation of the prior art has to do with the reliability and durability of these long shaft motors. In addition to the obstacles that can bend or destroy parts, the operation in shallow waters virtually ensures rapid wear and destruction of the seals that protect the bearings needed to support the rotating shaft. For the purposes of the present disclosure, it will be understood herein that bearings are used to refer to any type of member designed to permit one part to rotate with respect to another, and so will include oiled, greased or inherently lubricious parts such as are commonly referred to as bushings, ball or other types of roller or jeweled bearings, and any other known devices and apparatus that work accordingly. Unfortunately, as sand, dirt or other matter enters into the seals, the seals are rapidly destroyed. Once the seal is destroyed, the bearings are then exposed to excessive water flow and the very same matter that destroyed the seal. Consequently, once the seal fails, the life expectancy of the bearing is greatly reduced. Heretofore, commercially used seals and bearings have had a very short life expectancy, in some of the more extreme cases requiring replacement after only a few hours of operation in shallow, sandy-bottom waterways.

SUMMARY OF THE INVENTION

In a first manifestation, the invention is a marine propulsion linkage for connecting a propeller to a motive power source. The linkage includes a shaft adapted for rotation about a first axis having a first end and a second end terminating the shaft. A means couples the shaft to propeller adjacent the second end; An anti-cavitation body defines a partial cylinder having a longitudinal axis, a radius of curvature defined by a displacement of the anti-cavitation body with respect to the longitudinal axis, a degree of rotation defined by the angular extent of the body about the longitudinal axis and terminating at first and second edges of angular extent, the longitudinal axis angled with respect to first axis and forming an anti-cavitation chamber adjacent to the propeller and operatively generating a vacuum between the anti-cavitation body and a surface of a water body. First and second wings adjacent to the first and second edges of angular extent, respectively, are generally planar and operatively angled towards the bottom of a water body, wherein the first and second wings operatively run below the water body surface and thereby seal the anti-cavitation body to maintain generated vacuum therein.

In a second manifestation, the invention is a marine propulsion system having a power source, a rotary drive shaft, a casing surrounding the rotary drive shaft, and a propeller. At least one bearing separates the drive shaft from casing. A housing encloses the bearing and is attached to the casing at a first end and has a first opening adjacent the casing and a second opening distal thereto. A removable cover is adapted for enclosing the second opening and providing access to the bearing. A first thread is cut in a first helical direction adjacent an end of the rotary drive shaft adjacent the propeller, and slightly more distal therefrom and adjacent to the second opening a second thread is cut in a second helical direction opposed to said first thread helical direction, wherein the second thread drives matter away from the bearing.

OBJECTS OF THE INVENTION

Exemplary embodiments of the present invention solve inadequacies of the prior art by providing a particularly configured cavitation plate that sets the operating position of a long shaft propeller immediately adjacent to the water surface.

A first object of the invention is to provide an easily manually controlled long shaft propeller that inherently seeks the surface of the water. A second object of the invention is to simultaneously protect the propeller from damaging impacts. Another object of the present invention is to maintain relatively low mass and inertia. A further object of the invention is to provide improved protection to the seals, in turn increasing the life and durability of the bearings. Yet another object of the present invention is to reduce displacement of the boat by the prop other than along the water surface, so that the boat can track in a flat position and operate in shallower waters without sacrificing speed.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides a long shaft propeller that tracks to the surface of the water, and that further provides an extended seal and bearing life, thereby reducing the need for service or likelihood of failure during use.

Figure 1:
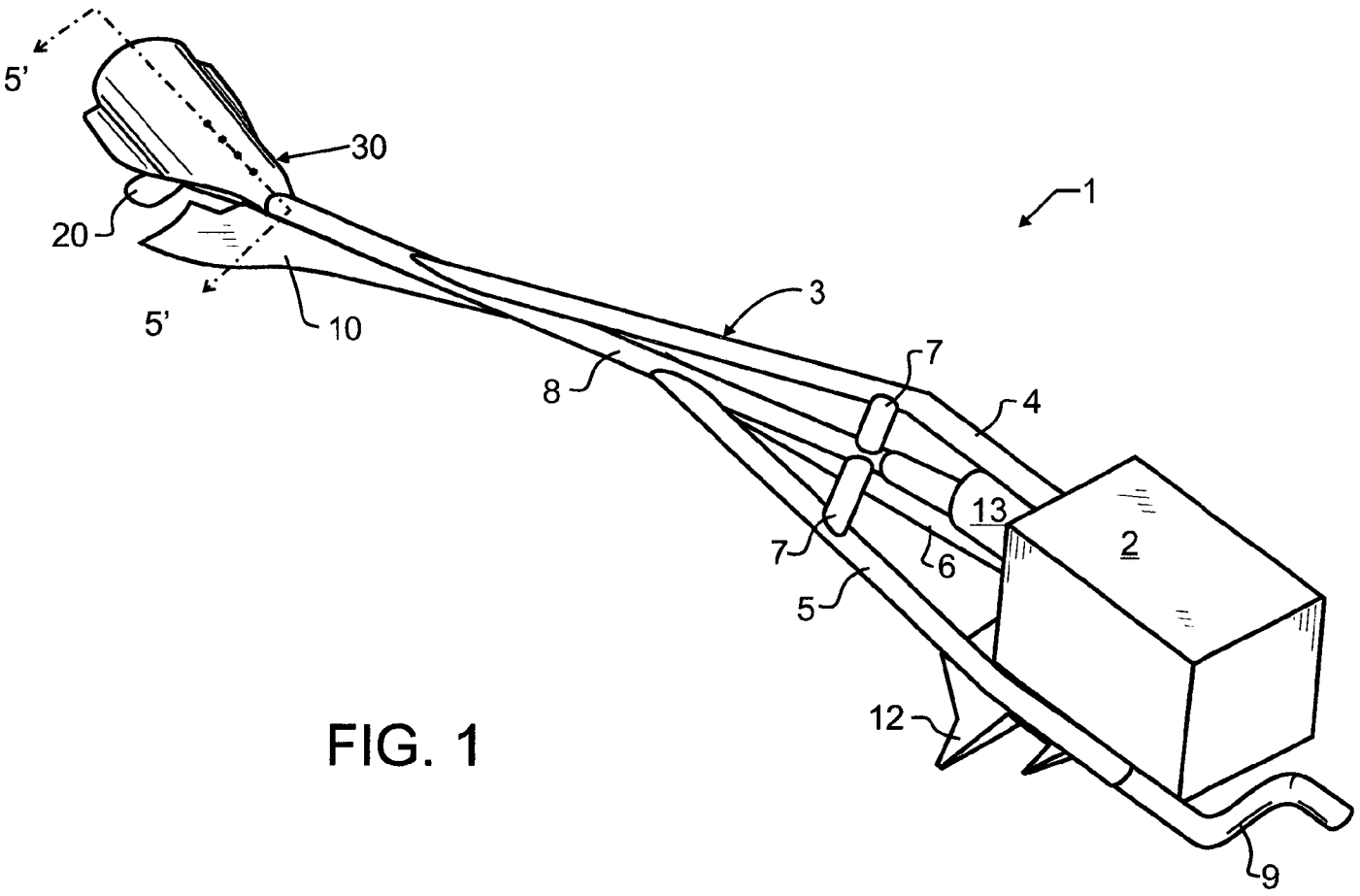
FIG. 1 illustrates a preferred embodiment long shaft propeller designed in accord with the teachings of the present invention from a projected view.
Figure 2:
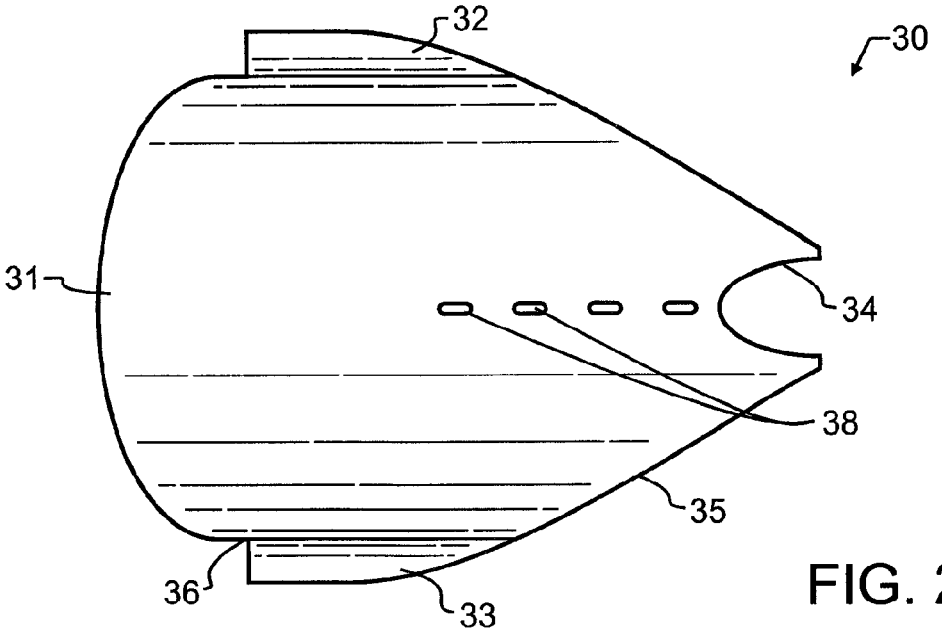
FIG. 2 illustrates a preferred embodiment cavitation plate designed in accord with the teachings of the present invention and illustrated in the preferred embodiment long shaft propeller of FIG. 1, from a top plan view.
Figure 3:
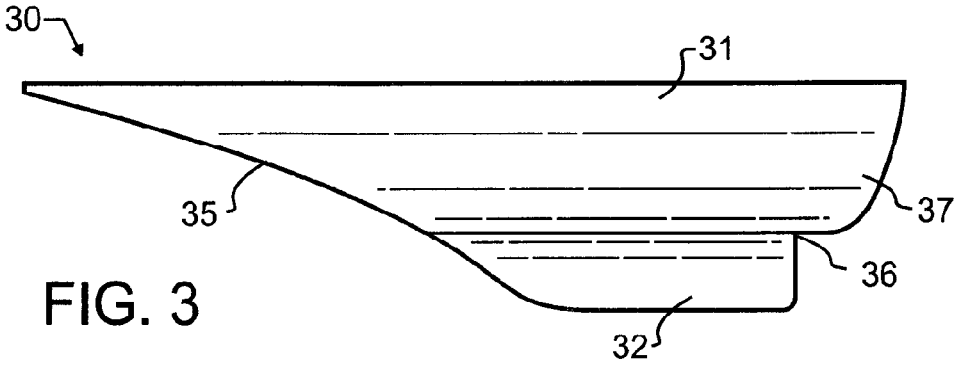
FIG. 3 illustrates the preferred embodiment cavitation plate of FIG. 2 from a side elevation view.
Figure 4:
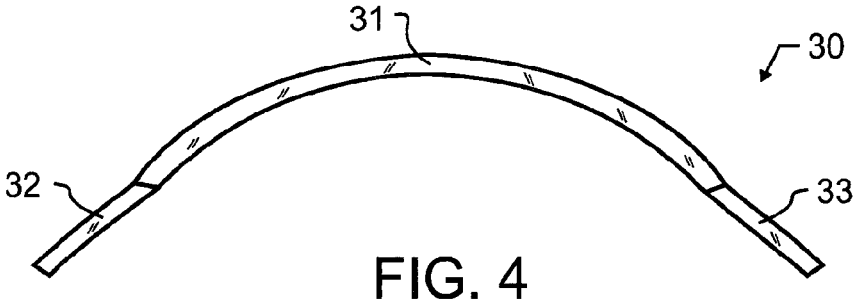
FIG. 4 illustrates the preferred embodiment cavitation plate of FIG. 2 from a rear elevation view.

A preferred embodiment long shaft propeller 1 is illustrated in FIG. 1. A transom mount 12 or suitable equivalent will most preferably be provided for coupling to a water craft such as a flat bottom boat or the like. A source of motive power 2, which will be known to those in the art to include such devices as internal combustion engines, electric motors and other known motive power sources is operatively connected through appropriate linkage, commonly including a universal joint, fasteners and other suitable couplers known in the art, and for exemplary purposes enclosed in safety shield 13, to propeller shaft 70 (visible in FIGS. 5 and 6). Shaft 70 passes through casing 8 to propeller 20. A framework 3 is preferably provided, though not essential to the invention, which adds structural integrity to casing 8 while only adding a minimum of mass. In the preferred embodiment long shaft propeller 1, this framework 3 is comprised of three legs 4-6 and optional cross-members 7, each which are preferably manufactured from hollow tubular material for optimum strength with minimal weight. Handle 9 is most preferably also manufactured from hollow tubular material that may be swaged or otherwise deformed or otherwise rendered capable of being coupled with legs 5 and 6, preferably by insertion into an open end of either leg 5 or leg 6. Some operators prefer to always use only one hand for directing propeller 20, and they will also prefer to sit on a particular side of the handle. By making handle 9 attachable with and removable from either leg 5 or leg 6, a particular operator may customize the placement of handle 9 within a boat to accommodate this preference. Additionally, and while not illustrated, it will be understood that a mechanical or electronic motor throttle, choke or control may be provided, such as but not limited to a hand control provided through a mechanical linkage or cable adjacent the operator end of handle 9.

Adjacent propeller 20, a rudder-like plate or skeg 10 serves to both assist in directional control and also to protect propeller 20 from impact with submerged objects or entanglement. The gentle and continuous slope 15 assists in less-forceful lifting of propeller 20 over any submerged objects. A steeper trailing edge 16 is designed to more forcefully push weeds, string, or other matter that may be sliding along slope 15 to be shifted down and away from the rotating propeller 20, preferably enough in advance of propeller 20 to prevent the debris or weeds from being contacted by propeller 20. However, the transition between slope 15 and trailing edge 16 is preferably sufficiently smooth and continuous to prevent the debris or weeds from becoming attached thereto.

Over the top of, and immediately adjacent to propeller 20 is a uniquely configured cavitation plate 30, illustrated in additional detail in FIGS. 2-5 and 7. Cavitation plate 30 has a generally tear-drop geometry from the top plan view of FIG. 2. An oval cut-out 34 is provided that is most preferably shaped to engage at an angle with casing 8, and preferably produce inconsequential drag therewith. Gentle tapering edges 35, like the gentle slope 15 on skeg 10, helps to guide propeller 20 smoothly and less forcefully around obstacles, while also preventing weeds, string or other matter from becoming affixed. An arcuate anti-cavitation body 31, defining a partial cylinder which may preferably have a center of radius approximately aligned with the axis of rotation of propeller 20, and which is also preferably only slightly larger in diameter than propeller 20, serves to contain water thereunder between anti-cavitation body 31 and propeller 20, develop a vacuum with the water surface tending to keep propeller 20 at the desired height typically partially above the average level of the relatively adjacent water surface, and also shields propeller 20.

The arcuate shape of anti-cavitation body 31 ends along two longitudinally extending edges adjacent transition 36, and wings 32 and 33 extend therefrom. Wings 32 and 33 each preferably have a separate center of radius that is both substantially offset sideways from the anti-cavitation body 31 center of radius, and also is preferably of a much larger radius than that of anti-cavitation body 31. In fact, wings 32 and 33 are generally planar, with only a very slight curvature.

The only sharp or discontinuous transition in cavitation plate 30 occurs at transition 36, which is at the tail end of wings 32, 33 and which allows anti-cavitation body 31 to extend into tail region 37 as much farther as desired or needed for proper operation. In the preferred embodiment, optional slots 38 are provided through which fasteners 14, visible in FIG. 5, may pass. Also visible in FIG. 5, a mounting support 11 for cavitation plate 30 is provided that is rigidly affixed to casing 8. A set of holes are provided therein, also through which fasteners 14 will pass. Consequently, cavitation plate 30 can be removably attached to mounting support 11. To accommodate different propellers, casings, and frameworks, an adjusting shim 17 may also be provided to permit small angular adjustments to be made between cavitation plate 30 and casing 8.

In operation, a relatively powerful vacuum is formed under anti-cavitation body 31, measured for exemplary purposes in one embodiment of the present invention at 5 inches, or 13 centimeters, of mercury. Wings 32, 33 operatively interact with and are submerged by the water, while anti-cavitation body 31 is primarily above the average water level. This means that a substantial force is created that draws cavitation plate 30 downward to the water surface, and thereby reduces the need for an operator to manually try to maintain a propeller level within the water. One of the functions of wings 32, 33 is to help maintain the seal against the water, even when small waves or surface ripples pass cavitation plate 30.

While the invention is not limited to the following theory of operation, and so no limitations are inferred as a consequence thereof, the dimensions of generally planar wings 32, 33 and the angular adjustment with casing 8 are each selected to provide sufficient drag in the water that, if they become submerged too far, they will force sufficient water down to lift propeller 20. If instead propeller 20 lifts to try to rise out of the water, these wings 32 and 33 may begin to catch water and pull propeller 20 downward. In addition, anti-cavitation body 31 is reacting with propeller 20, to generate a vacuum when anti-cavitation body 31 rises out of the water. This prevents propeller 20 from continuing upward and popping out of the water. As should be understood, this combination of anti-cavitation body 31, which forms a partial circumference of a tube, and wings 32, 33 which seal vacuum under anti-cavitation body 31 and which directly react with the water, form a very complex interaction between the body of water and cavitation plate 30. When the angle of cavitation plate 30 is properly set with adjusting shim 17 or by other equivalent permanent or adjustable means, propeller 20 will be constrained to stay immediately adjacent to and partially above the normal level for the water body. Consequently, there is reduced interference with shallow bottoms, sand bars, and submerged obstacles compared to a prior art long shaft propeller. Further, the consequential forces generated by cavitation plate 30 allow an operator to steer the boat by pivoting long shaft propeller 1 about a vertical axis, without significant concern for also manually controlling the depth of propeller 20, which is rotation about a horizontal axis. Instead, cavitation plate 30 acts as the depth controller, relieving both the need for attention and physical exertion. Additionally, cavitation plate 30 improves the efficiency of propeller 20, producing more propulsion than without cavitation plate 30, even when propeller 20 without cavitation plate 30 is run at deeper levels within the water body.

Figure 5:
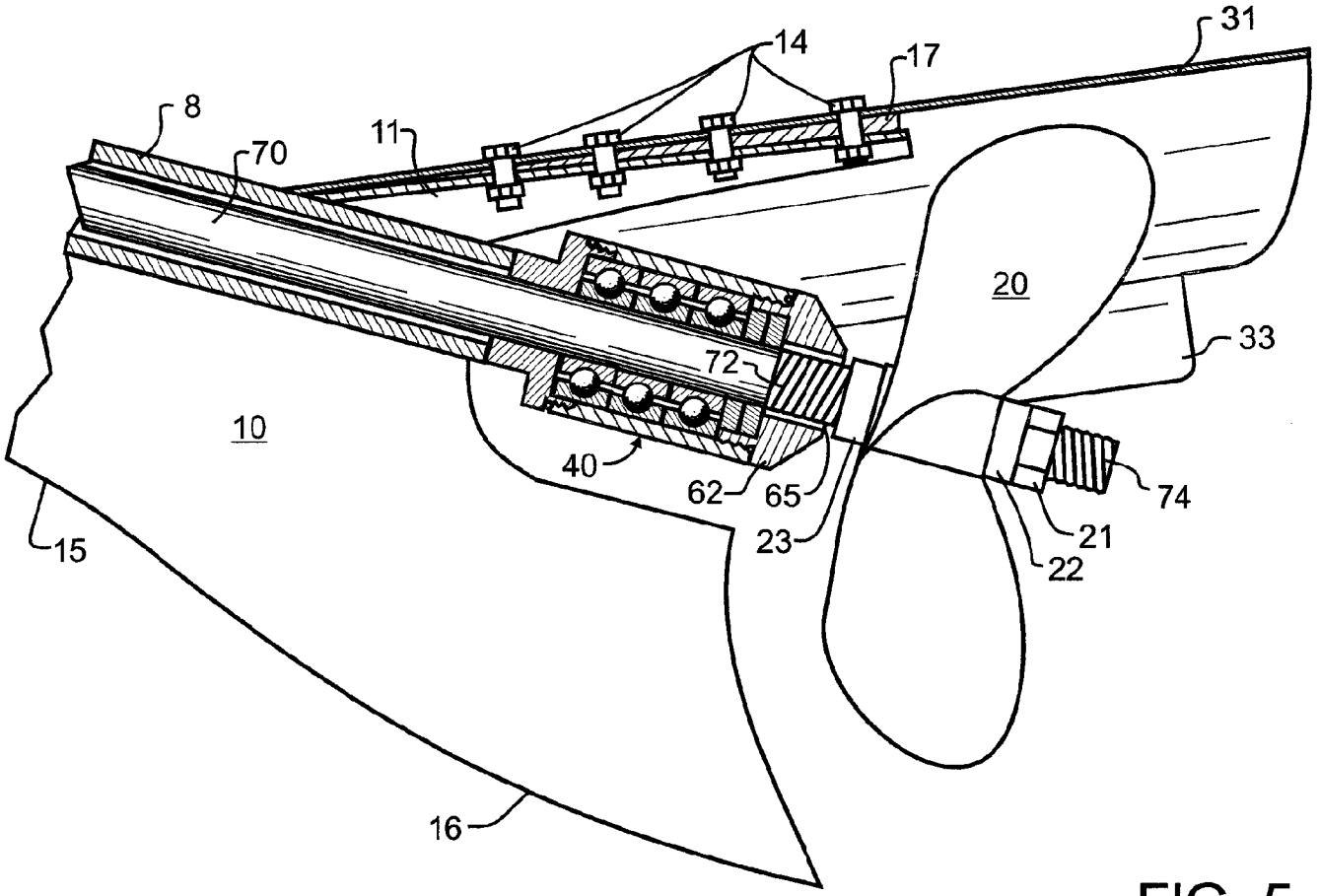
FIG. 5 illustrates the coupling of the preferred embodiment cavitation plate of FIG. 2 into the preferred embodiment long shaft propeller of FIG. 1, as well as the preferred embodiment propeller bearing seal protector, by a partial section view taken along line 5' of FIG. 1.
Figure 6:
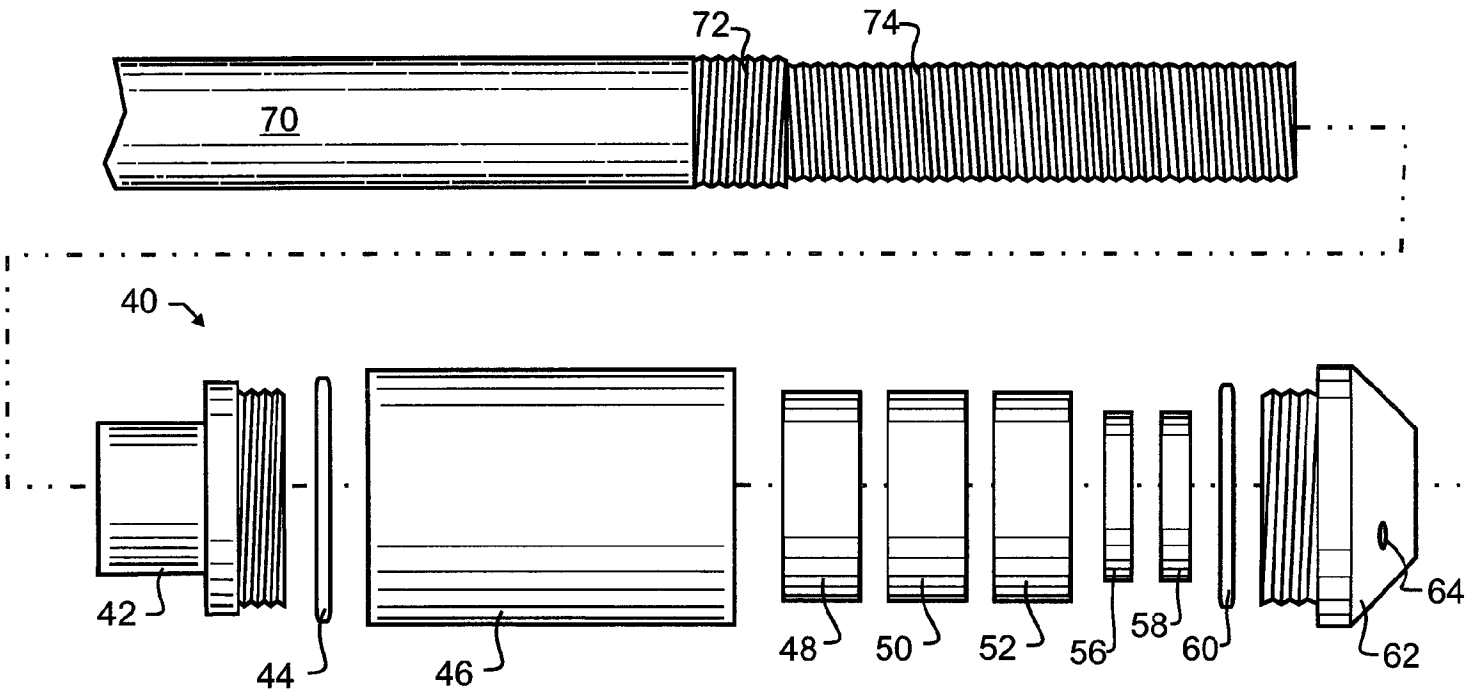
FIG. 6 illustrates the preferred embodiment propeller bearing seal protector and bearing housing of FIG. 5 from an exploded view.
Figure 7:
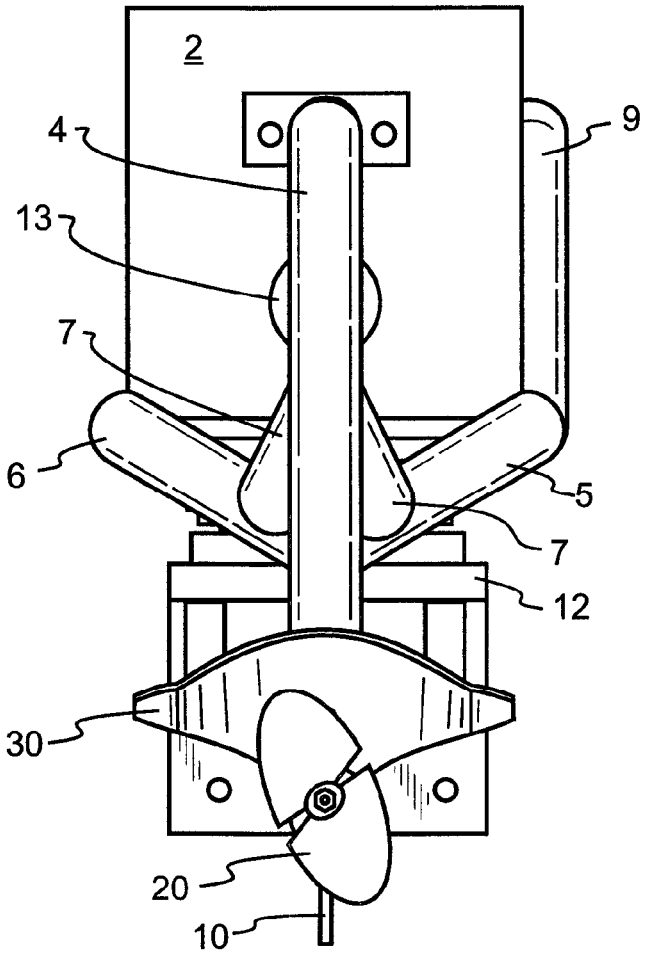
FIG. 7 illustrates the preferred embodiment long shaft propeller of FIG. 1 from a rear elevation view.

FIGS. 5 and 6 include illustrations of a preferred bearing, bearing seal protector, and propeller coupling. At the end of casing 8 adjacent propeller 20 is a sealed bearing unit 40 that in the preferred embodiment provides ball-bearing support for propeller shaft 70 within casing 8, thereby minimizing friction while improving the life and reliability of long shaft propeller 1. Sealed bearing unit 40 is illustrated by exploded view in FIG. 6 and partial cross-section in FIG. 5, and includes a bearing housing 46 threaded onto a threaded nose 42 which is designed to be rigidly affixed to casing 8. A rubber O-ring or equivalent seal 44 is preferably provided there between. Most preferably, the interior of bearing housing 46 defines a bearing compartment that will be sufficiently large that bearings 48-52 may contain not only a bearing, but also be provided with inner and outer bearing races. This is most preferred, since the construction of bearings is a precise art where small deviations are known to have adverse affects upon the performance of the bearings. Furthermore, special materials and treatments are required, the processes which are highly refined in the production of reliable bearings. These processes are used in high volume in the production of bearings, thereby adding little to the total cost of the bearing. However, to incorporate this level of precision and processing into the present bearing unit 40 would add undesirably to the cost, and, absent the full technology used in the bearing industry, would also lead undesirably to lower production yields and greater failures during use.

Once bearings 48-52 are inserted within bearing housing 46, shaft seals 56, 58 are inserted. These seals 56, 58 may for exemplary purposes be elastomeric, and will engage with and seal shaft 70. Seals 56, 58 may also optionally include grease or the like, not only for lubrication, but also for the water repellent nature of grease and oil. Through either or both grease or other hydrophobic matter and shaft seals 56, 58, no water should penetrate into bearing housing 46. Threads will engage cover 62 with bearing housing 46, and may solely be used as the final seal against water intrusion into bearing housing 46. However, it is also contemplated to provide an elastomeric seal 60, which may be a washer or O-ring, between cover 62 and bearing housing 46. One or more small surface indentations 64, which do not pass entirely through cover 62, may be provided to receive a spanner wrench-like tool that enables cover 62 to more easily be turned relative to bearing housing 46.

Unfortunately, even with the best of seals 56, 58, foreign material such as fine sand, thread, string or other matter may migrate into these seals 56, 58. In such case, the rotation of shaft 70 will rapidly lead to wear and failure of seals 56, 58, exposing the bearings directly to water and similar fine sand, thread, string and the like. Consequently, bearings 48-52 are more prone to failure after seals 56, 58 have failed.

To protect bearing seals 56, 58, and as best viewed in FIGS. 5 and 6, cover 62 has a bore 65, visible in FIG. 5, that non-frictionally accommodates threads 72 therein. Threads 72 are threaded oppositely to threads 74. As illustrated in FIG. 5, shaft 70 will rotate when viewed from the end with threads 74 in a counter-clockwise fashion. This means that threads 74, which are cut in a clock-wise manner, will tend to push any sand, debris, string, weeds, or any other matter up shaft 70 towards bearing seals 56, 58. Most undesirably, this action by threads 74, if left unaltered, can greatly accelerate the failure of seals 56, 58.

The present invention overcomes this limitation of the prior art by providing opposed threads 72, 74. In the preferred embodiment, threads 74 are cut in a clockwise manner. Consequently, threads 72 will be cut in a counter-clockwise manner. This means that any string, debris or other matter will be pushed by threads 72 away from seals 56, 58. A close tolerance between bore 65 and threads 72 will improve the efficiency of threads 72, but there needs to be sufficient space there between to accommodate tolerances, minor shaft flexure and the like as well. Furthermore, if so desired, a softer or resilient sleeve might be provided to fill any space between bore 65 and threads 72, such that if there were an event that caused relative movement between bore 65 and threads 72, only the sleeve would be destroyed. Further, such a sleeve could be designed to be removable and replaceable, again if so desired.

Relatively close tolerance between bore 65 and threads 72 has other important benefit. When debris, a rock, other obstacle or the like is hit by propeller 20, in the prior art this would commonly bend shaft 70 within seals 56, 58. A bend at that location would cause aggressive wear and rapidly tear or otherwise destroy seals 56, 58. Furthermore, the vibration from the bent shaft would also cause much greater bearing wear. However, when there is only a small gap between bore 65 and threads 72, preferably sufficiently small that non-yielding flexure in shaft 70 will close or bridge the gap, then in the event of an impact, shaft 70 will be bent and threads 72 will contact the lip of bore 65 most adjacent to propeller 20. When threads 72 contact bore 65, then cover 62 acts as additional shaft reinforcement, effectively stiffening shaft 70 and in most cases avoiding permanently deforming shaft 70. In the event of an impact still sufficiently powerful to permanently deform shaft 70 even with the stiffening provided by cover 62, cover 62 moves the bend away from the bearings and seals, and more nearly adjacent to the propeller. This not only helps to permit the boat to still be propelled back to dock or shore, even if at a reduced speed, but also simplifies repair or straightening.

Threads 74 are used to hold propeller 20, and an internally threaded split nut 23, having a cylindrical exterior, is preferably used to rigidly locate propellor 20 on one face. On the opposed face, a washer, small tube 22 or the like may be provided, in turn locked into place by nut 21. Split nut 23 has a cylindrical exterior that ensures no disruption of water flowing into propeller 20, and the smooth surface also reduces the likelihood that weeds and other debris will tangle and remain thereon. As known in the hardware art, a split nut is completely split through one radial cut, and the cut may be closed with a threaded bolt or the like. 180 degrees removed from the complete split is preferably a partial cut terminated with a round hole or the like. This allows the two halves of the split nut to flex and move away from each other similar to shackles or hand cuffs, facilitating the removal of split nut 23 from threads 74, while also avoiding turbulence and weed entanglement.

As best visible in FIG. 6, thread 72 may be cut in shaft 70 at the full diameter of shaft 70, and may be cut all the way from the end of shaft 70. Next, shaft 70 may optionally be turned or otherwise machined to remove threads 72 completely in the region of shaft 70 ultimately intended to receive threads 74. Otherwise, a suitable thread cutting die may fabricated and used that simply cuts thread 74 deep enough to remove any remnants of threads 72. In the process of forming threads 74, shaft 70 in this region of threads 74 is smaller in diameter than in the region of thread 72 or in the unthreaded region. An additional benefit is obtained from this. Since propellor 20 is ultimately supported on threads 74, in the event of a major and damaging impact, shaft 70 will be slightly stronger in the unthreaded region than in threads 72, and threads 72 are slightly stronger than threads 74. Consequently, in the event of as damaging overload, shaft 70 will preferentially bend either in threads 74 or at the juncture between threads 74 and threads 72. The change in diameter will be selected at the time of design, but with a larger change in diameter better protecting the unthreaded region of shaft 70 from harm.

Another advantage comes from the use of the present housing 46. In use, when a bearing fails, the failure often times destroys the bearing but less frequently damages shaft 70 or bearing housing 46. Consequently, only bearings 48-52 will need replacement, and, as long as relatively common bearings are used for bearings 48-52, these bearings may be obtained from bearing supply sources, hardware dealers and the like which are located in most small towns throughout the world. The exact type of bearing used is not critical to the invention, and different types including ball and roller bearings are contemplated herein. Nevertheless, while less preferred, it is also contemplated herein to use bearings such as needle bearings and the like which do not include outer races, and which would therefore consume less space, and instead use bearing housing 46 as the outer race. Using bearings without a race provides a size advantage, since, without bearing races, bearing housing 46 may be made with a much smaller outside diameter more closely resembling or even the same as casing 8.

Three bearings 48-52 are most preferred, owing to the affects of bending within shaft 70 during operation, particularly when an obstacle is encountered. When shaft 70 is flexed out of being exactly coaxial with bearing housing 46, a force is applied radially in a first direction against bearing 48 and radially in an opposite direction against bearing 52, while bearing 50 will operate essentially in balance and serve as a point of pivot for shaft 70. The benefit is the lack of twisting forces applied to a single bearing, thereby enhancing the overall life of the bearing structure. Furthermore, the total load supported by the three bearings 48-52 is, of course, distributed across all three bearings. While it may be possible to manufacture a bearing structure having only one or two bearings therein, it is less preferred.

Bearing housing 46 and cover 62 may be machined from carbon steel, stainless-steel or other suitable material. The exact material is not critical to the performance of the invention, provided there is sufficient strength to withstand the forces of impact that may occur during use, as well as the forces which occur during general use, and sufficient corrosion resistance to withstand the intended marine application. The geometries illustrated are all cylindrical, which allows bearing housing 46 and cover 62 to each be manufactured through reasonably low-cost turning and drilling procedures.

In use, shaft 70 passes through the center of bearing housing 46 into the center of ball bearings 48-52, where shaft 70 is radially supported. In the event bearings 48-52 should seize and rotate relative to housing 46, housing 46 may be damaged. Nevertheless, should this occur housing 46 may then be removed and replaced. While a local source may not be available, the overnight shipping charges for bearing housing 46 are substantially lower than for a full casing 8. Similarly, in the event casing 8 should be damaged and unusable, only casing 8 must be replaced and not bearing housing 46. Likewise, should shaft 70 be the only damaged component, then only shaft 70 will need replaced.

In the event one or more bearings 48-52 fail without damaging bearing housing 46, bearing housing 46 may be removed from casing 8 and shaft 70, and then cover 62 and seals 56, 58 are removed. Finally, a punch, screw-driver or the like may be used to press axially against the side of any bearing 48-52, to press the bearings 48-52 out of bearing housing 46. The ability to remove bearing housing 46 from casing 8 allows better access to bearings 48-52. Other techniques known in the bearing arts may be provided to assist with the removal of bearings.

While bearing housing 46 is most preferably removable from casing 8, it is conceivable that bearing housing 46 could be manufactured to be an integral part thereof. In this case, access to bearings 48-52 may be somewhat more difficult. Regardless of whether removable or integral, bearing housing 46 will still preferably present an outer surface which most closely resembles the outer surface of casing 8. When the turbulence becomes too great, or when bearing housing 46 has too great a protrusion from casing 8, water will spray up into the air when propeller 20 is operated in shallow water. This is very undesirable.

While the foregoing details what is felt to be the preferred embodiment of the invention, no material limitations to the scope of the claimed invention are intended. Further, features and design alternatives that would be obvious to one of ordinary skill in the art are considered to be incorporated herein. For example, while a strong and corrosion resistant material such as stainless, coated or otherwise treated steel is described as preferable for manufacturing, alternative materials such as ABS plastic and the like are also contemplated. These and other materials might also be produced using different manufacturing techniques as well, such as molding or casting. The scope of the invention is set forth and particularly described in the claims herein below.

We claim:

1. A marine propulsion linkage for connecting a propeller to a motive power source, comprising:

a shaft adapted for rotation about a first axis having a first end and elongated along said first axis from said first end to a second end, said first and second ends terminating said shaft;

a means for coupling said shaft to said propeller adjacent said second end;

a casing generally co-axial with and circumscribing at least a portion of said shaft between said first and second shaft ends;

an anti-cavitation body defining a partial cylinder having a longitudinal axis, a radius of curvature defined by a displacement of said body with respect to said longitudinal axis, a degree of rotation defined by the angular extent of said body about said longitudinal axis and terminating at first and second edges of angular extent, said longitudinal axis angled with respect to said first axis and forming an anti-cavitation chamber adjacent to said propeller and operatively enclosing a vacuum between said anti-cavitation body and a surface of a water body;

first and second wings adjacent to said first and second edges of angular extent, respectively, angularly offset from said partial cylinder to extend radially outward therefrom and operatively angled into said water body, wherein said first and second wings are adapted to operatively run below said water body surface and thereby improve a seal between said anti-cavitation body and said water body surface to better maintain said generated vacuum therein;

a mounting support rigidly coupled to said casing, said anti-cavitation body removably rigidly coupled to said mounting support; and a means for making small angular adjustments between said anti-cavitation body and said casing, whereby an angle between said anti-cavitation body and said casing is adjustable to constrain said propeller immediately adjacent to and partially above a normal level for said surface of said water body.

2. The marine propulsion linkage of claim 1, wherein said means for making small angular adjustments between said anti-cavitation body and said casing further comprises an adjusting shim.

3. The marine propulsion linkage of claim 2, wherein said anti-cavitation body has a diameter similar to said propeller and is adapted to operatively contain water between said anti-cavitation body and said propeller, thereby developing said vacuum there between.

4. The marine propulsion linkage of claim 1, wherein said first and second wings are generally planar.

5. The marine propulsion linkage of claim 1, wherein said first and second wings each have a separate center of radius that is both substantially offset sideways from said anti-cavitation body center of radius, and also have a radius that is larger than said anti-cavitation body radius of curvature.

6. The marine propulsion linkage of claim 1, wherein said first and second wings extend longitudinally with said anti-cavitation body adjacent to said propeller and terminate spaced and distal from said anti-cavitation body mounting support.

7. A marine propulsion linkage for connecting a propeller to a motive power source and operative within a body of water having an average surface level and surface waves therein, comprising:

a shaft adapted for rotation about a first axis having a first end and elongated along said first axis from said first end to a second end, said first and second ends terminating said shaft;

a means for coupling said shaft to said motive power source adjacent said first end;

a means for coupling said shaft to said propeller adjacent said second end;

a casing enclosing said shaft between said first and second ends;

a generally planar skeg coupled with and descending in a generally vertical plane from said casing;

a framework adding structural integrity to said casing;

a pivotal transom mount permitting said shaft, casing and framework to pivot about two orthogonal axes;

a handle coupled to said framework and adapted to operatively allow said propeller to be pivoted about a generally horizontal axis to thereby raise and lower said propeller within a body of water, and adapted to operatively allow said propeller to be pivoted about a generally vertical axis to thereby shift said propeller between port and starboard of said transom mount;

an anti-cavitation body having a generally tear-drop geometry from a top plan view and including an oval cut-out defining a leading edge adjacent to and engaging said casing and gentle tapering edges extending from said casing and adapted to operatively guide said propeller around obstacles while also preventing foreign matter from becoming affixed adjacent to said oval cut-out, said anti-cavitation body further defining a partial cylinder from a rear elevational view and having a longitudinal axis and a radius of curvature about said longitudinal axis only nominally larger in diameter than propeller and extending from said leading edge to a trailing edge partially encompassing and extending beyond said propeller;

a mounting support rigidly affixed to said casing;

a plurality of holes through said cavitation plate;

a plurality of fasteners passing through said plurality of holes and removed ably attached to said mounting support; and an adjusting shim between said anti-cavitation body adjacent to said leading edge and said mounting support and adapted to operatively permit small angular adjustments to be made and fixed between said anti-cavitation body and said casing.

8. The marine propulsion linkage of claim 7, further comprising first and second wings adjacent to said first and second edges of angular extent, respectively, and angled into said water body deeper than said anti-cavitation body, wherein said first and second wings are adapted to operatively run below said water body surface and improve a seal between said anti-cavitation body and said water body adjacent to said propeller and adapted to operatively develop a vacuum with said water body to contain water between said anti-cavitation body and propeller and thereby tend to keep propeller at a level partially above said water body average surface level.

9. The marine propulsion linkage of claim 8, wherein said first and second wings and an angular adjustment of said anti-cavitation body relative to said casing are each adapted to operatively provide sufficient drag in said body of water when said anti-cavitation body becomes fully submerged in said body of water to operatively force water down and thereby in turn lift said propeller, and if said propeller lifts above said body of water, said first and second wings operatively catch water and pull said propeller downward into said body of water and said anti-cavitation body reacts with said propeller and said body of water to generate a vacuum to operatively tend to constrain said propeller immediately adjacent to and partially above said average surface level of said body of water.

10. The marine propulsion linkage of claim 8, wherein said first and second wings each are angularly offset from said partial cylinder to extend radially outward therefrom.

11. The marine propulsion linkage of claim 10, wherein said first and second wings each further comprise a longitudinal axis that is both laterally displaced from said anti-cavitation body longitudinal axis, and is of a larger radius of curvature than said anti-cavitation body radius of curvature.

12. The marine propulsion linkage of claim 8, wherein said first and second wings further comprise generally planar surfaces.

13. The marine propulsion linkage of claim 8, wherein said first and second wings further extend in a direction parallel to said anti-cavitation body longitudinal axis adjacent to said anti-cavitation body trailing edge and terminate longitudinally distally from said anti-cavitation body leading edge.

14. A marine propulsion linkage for connecting a propeller to a motive power source and operative within a body of water having an average surface level and surface waves therein, comprising:

a shaft adapted for rotation about a first axis having a first end and elongated along said first axis from said first end to a second end, said first and second ends terminating said shaft;

a means for coupling said shaft to said motive power source adjacent said first end;

a means for coupling said shaft to said propeller adjacent said second end;

a casing enclosing said shaft between said first and second ends;

a mounting support rigidly affixed to said casing;

a pivotal transom mount permitting said shaft and casing framework to pivot about two orthogonal axes;

an anti-cavitation body having a generally tear-drop geometry from a top plan view and including an oval cut-out defining a leading edge adjacent to and engaging said casing and gentle tapering edges extending from said casing and adapted to operatively guide said propeller around obstacles while also preventing foreign matter from becoming affixed adjacent to said oval cut-out, said anti-cavitation body further defining a partial cylinder from a rear elevational view and having a longitudinal axis and a radius of curvature about said longitudinal axis of similar and larger diameter than propeller and extending from said leading edge to a trailing edge partially encompassing and extending beyond said propeller;

a plurality of holes through said anti-cavitation body;

a plurality of fasteners passing through said plurality of holes and removed ably attached to said mounting support; and an adjusting shim between said anti-cavitation body adjacent to said leading edge and said mounting support and adapted to operatively permit small angular adjustments to be made and fixed between said anti-cavitation body and said casing.

15. The marine propulsion linkage of claim 14, further comprising first and second wings adjacent to said first and second edges of angular extent, respectively, and angularly offset from said partial cylinder to extend radially outward therefrom, and angled into said water body deeper than said anti-cavitation body, wherein said first and second wings are adapted to operatively run below said water body surface and improve a seal between said anti-cavitation body and said water body adjacent to said propeller and adapted to operatively develop a vacuum with said water body to contain water between said anti-cavitation body and propeller and thereby tend to keep propeller at a level partially above said water body average surface level.

16. The marine propulsion linkage of claim 15, wherein said first and second wings each further comprise a longitudinal axis that is both laterally displaced from said anti-cavitation body longitudinal axis, and is of a larger radius of curvature than said anti-cavitation body radius of curvature.

17. The marine propulsion linkage of claim 15, wherein said first and second wings further extend in a direction parallel to said anti-cavitation body longitudinal axis adjacent to said anti-cavitation body trailing edge and terminate longitudinally distally from said anti-cavitation body leading edge.

18. The marine propulsion linkage of claim 15, wherein said first and second wings and an angular adjustment of said anti-cavitation body relative to said casing are each adapted to operatively provide sufficient drag in said body of water when said anti-cavitation body becomes fully submerged in said body of water to operatively force water down and thereby in turn lift said propeller, and if said propeller lifts above said body of water, said first and second wings operatively catch water and pull said propeller downward into said body of water and said anti-cavitation body reacts with said propeller and said body of water to generate a vacuum to operatively tend to constrain said propeller immediately adjacent to and partially above said average surface level of said body of water.

* * * * *